US005669145A

United States Patent [19]

Skripsky

[11] Patent Number: 5,669,145

[45] Date of Patent: Sep. 23, 1997

[54] CHAINSAW ATTACHMENT

[76] Inventor: Harold O. Skripsky, 4296 Fox Meadow Dr. SE., Cedar Rapids, Iowa 52403

[21] Appl. No.: 631,146

[22] Filed: Apr. 15, 1996

[51] Int. Cl.[6] ..... B27B 17/02

[52] U.S. Cl. ..... 30/371; 30/382

[58] Field of Search ..... 30/321, 374, 382, 30/383

[56] References Cited

U.S. PATENT DOCUMENTS

| | | |
|---|---|---|
| 2,642,901 | 6/1953 | Hayden . |
| 2,698,034 | 12/1954 | Jakku . |
| 2,925,105 | 2/1960 | Hayden . |
| 2,930,416 | 3/1960 | Granberg . |
| 3,808,684 | 5/1974 | Ludwig . |
| 3,815,229 | 6/1974 | Granberg . |
| 4,142,292 | 3/1979 | Ulrich . |
| 4,173,240 | 11/1979 | Boyce . |
| 4,270,272 | 6/1981 | Graham . |
| 4,888,872 | 12/1989 | Eistrat . |
| 5,123,168 | 6/1992 | Lyons . |
| 5,156,156 | 10/1992 | Ruzich . |
| 5,511,315 | 4/1996 | Raya ..... 30/371 |

*Primary Examiner*—Douglas D. Watts
*Attorney, Agent, or Firm*—James C. Nemmers

[57] ABSTRACT

An attachment for chain saws that provides a pivot point for better cutting leverage and control especially when cutting small tree branches or limbs. The attachment is installed on both sides of the saw chain and has two or more angularly and outwardly extending prongs that pull the limbs into the chain so that they can be more easily cut. Spacers between the chain bar and the attachment provide for proper clearance for the chain and allow easy installation and removal of the attachment. The attachment also is reversible so that it can be used for creating a straight cut using a straight edge as a guide and for controlling the depth of a cut when cutting a kerf in timbers or logs.

3 Claims, 2 Drawing Sheets

FIG. 1
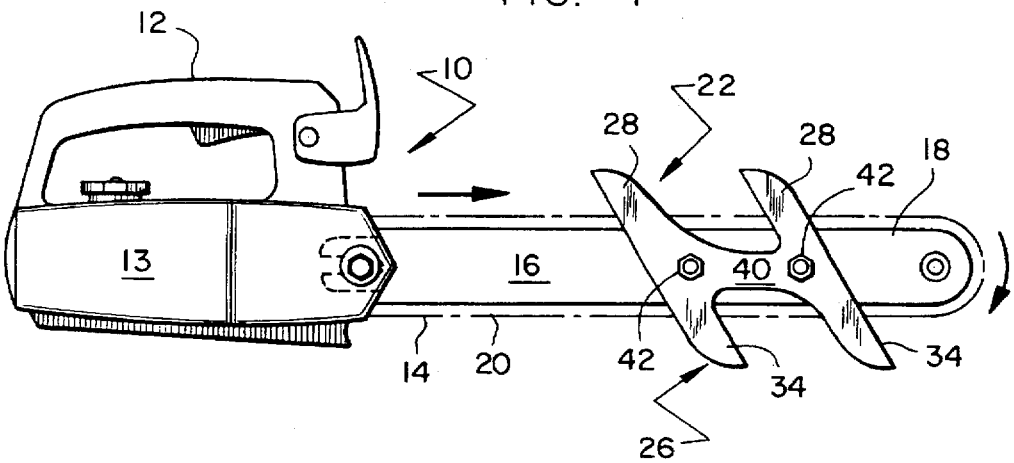
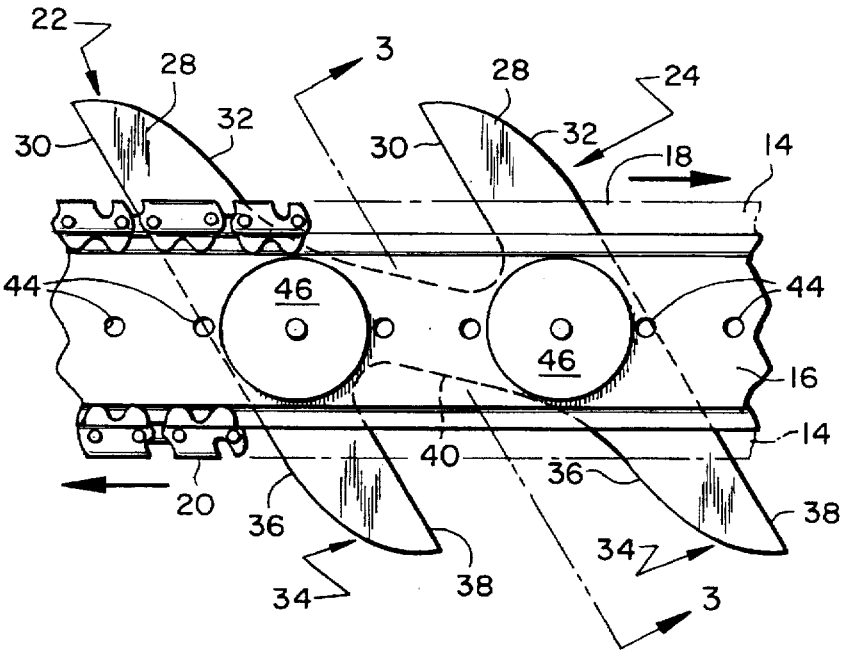
FIG. 2
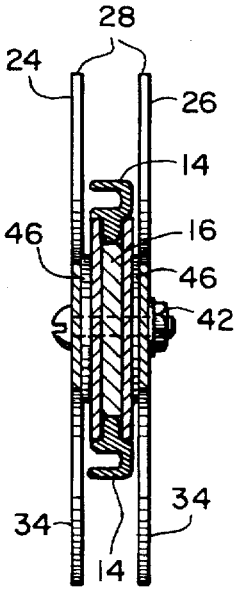
FIG. 3

FIG. 4
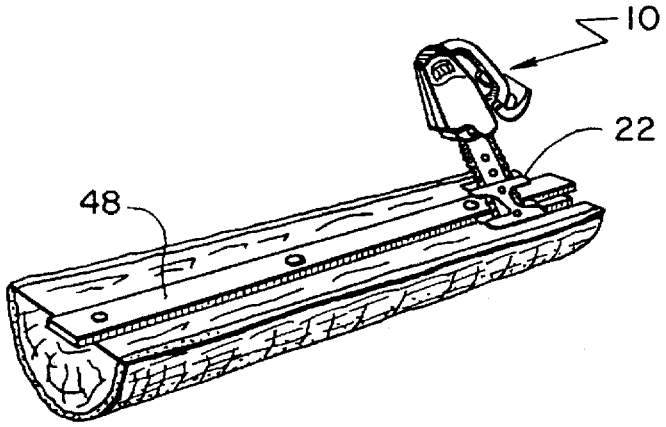
FIG. 6
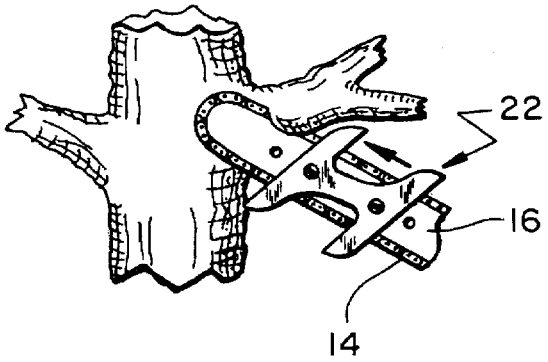
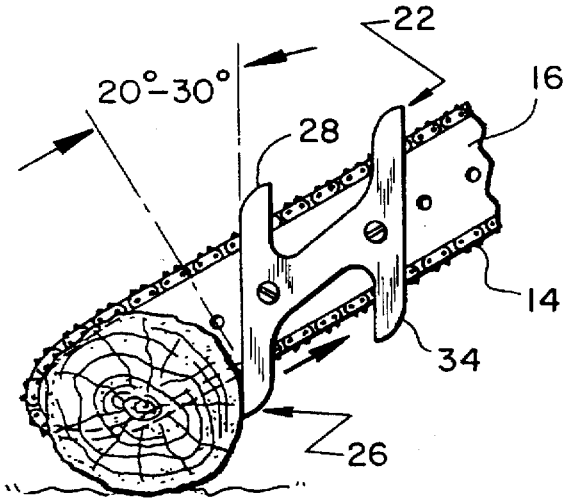
FIG. 5

CHAINSAW ATTACHMENT

BACKGROUND OF THE INVENTION

Chain saws are a common power tool designed mainly for the purpose of cutting large wooden objects such as trees and large limbs or timbers. Chain saws are powered by either a gasoline engine or an electric motor. In either case, chain saws are portable. Although chain saws are very effective when used to cut relatively large wooden objects, they are not so effective when used to cut small limbs, brush and hedges which are springy. When a chain saw is used to cut small limbs, brush and hedges, these items will often be pulled and kicked back away from the chain saw making it both difficult and dangerous to attempt to cut these small somewhat springy items. There have been developed and are known a number of attachments that attempt to solve some of these problems. Many are very specialized or restrictive in their uses. For example, the prior art teaches the use of prongs or stops that extend outwardly beyond the teeth of the chain saw and attempt to stop the small tree limb so that it can be more easily cut. Many of these prior art designs are not satisfactory and they do not work effectively because of the angle or proper spacing and clearance of the stop or prong, and as a result, many of the prior art attachments are somewhat difficult to install on and remove from the chain saw. Moreover, many of the prior art attachments are positioned on the chain blade so as to interfere with other uses of the chain saw and therefore have to be removed when the chain saw is used for cutting small trees or larger limbs or for cutting groves in a wood beam.

There is therefore a need for an improved chain saw attachment that can be easily installed and removed but which can be left in place for most used of the chain saw. There is a further need for an improved attachment for chain saws which will assist in the cutting of kerfs in timbers or logs by controlling the depth of the cut and guiding the saw along a straight edged guide.

SUMMARY OF THE INVENTION

The attachment of the invention has two or three prongs that extend above and below the chain blade on both sides of the saw and also extend at an angle that will actually pull the small limbs into the chain. The prongs of the attachment are installed on both sides of the chain bar using spacers that provide for proper clearance for the chain and allow easy installation and removal of the attachment. The attachment also is reversible so that it can be used to control the depth of a cut or to follow a straight edged guide when cutting a kerf in timbers. The attachment of the invention also is useful when cutting through roofs or walls of a building structure.

BRIEF DESCRIPTION OF THE DRAWING

FIG. 1 is a side elevational view of a chain saw with the attachment of the invention in place;

FIG. 2 is an enlarged view of a portion of the chain saw bar with one-half of the attachment removed to show the details of the spacers;

FIG. 3 is a sectional view taken on the line 3—3 of FIG. 2;

FIG. 4 is a perspective view illustrating the use of the invention when cutting a kerf;

FIG. 5 is a view illustrating that a chain saw using the attachment of the invention can still be used to cut larger timbers without removal of the attachment; and FIG. 6 is a view illustrating use of the attachment in cutting limbs.

DESCRIPTION OF THE PREFERRED EMBODIMENT OF THE INVENTION

Referring to FIG. 1, there is illustrated a chain saw 10 of any suitable type that has a handle 12 so that it can be grasped by the hands of the user, which handle 12 is attached to a housing 13 that contains the motor and drive for a chain 14 containing cutting teeth as is well known. The chain 14 travels around and is guided by the chain bar 16. The chain 14 travels away from the housing 12 along the top 18 of the chain bar 16 and then returns across the bottom 20 of the chain bar 16. Obviously, the chain 14 will cut anything it comes in contact with as it travels either across the top 18 or bottom 20 of the chain bar 16.

The problem to which the invention is directed is the fact that when the chain saw 10 is used to cut small limbs or branches or is used for pruning bushes, shrubs, etc., these smaller items tend to kick out away from the chain 14 without being cut. There is also a safety factor when cutting these smaller items since they can be kicked out and injure the user or any bystander. The attachment of the invention is indicated generally by the reference numeral 22 and consists of two identical stop members 24 and 26, stop member 24 being positioned on the left side of the chain bar 16 while stop member 26 is positioned on the right side. Each stop member 24 and 26 has a pair of outwardly extending prongs 28 that extend beyond the top 18 of the chain bar 16. Each prong 28 has an inner edge 30 that extends outwardly and rearwardly toward the direction of the housing 13, preferably at an angle of 20 to 30 degrees from the vertical or from a line perpendicular to the top 18 of the chain bar 16. The front edge 32 of each of the prongs 28 extends generally at the same angle as the rear edge 30, but as best seen in FIG. 2, the upper portion of the front edge 32 is curved and joins the rear edge 30 at the uppermost point of the prong 28.

Each stop member 24 and 26 also has a pair of prongs 34 that extend outwardly and downwardly from the bottom 20 of the chain bar 16. The rear edge 36 of each prong is at the same angle relative to the chain bar 16 as the front edges 32 of prongs 28. Similarly, the front edge 38 of each prong 34 is straight and is at the same angle relative to the chain bar 16 as the rear edges 30 of the prongs 28, that is, in the range of 20 to 30 degrees relative to a line perpendicular to the bosom 20 of the chain bar 16. Like the front edge 32 of each top prong 28, the rear edge 36 of each prong 34 is curved toward and joins the edge 38 at the outermost edge of the prong 34.

Each pair of upper prongs 28 and lower prongs 34 are joined to an adjacent pair by a connecting member 40. Preferably, a pair of upper prongs 28 and lower prongs 34 are formed integrally along with a connecting member 40 to form a stop member 24 or 26 as a single piece. When assembled on the chain saw 10, the right side stop member 26 and left side stop member 24 are positioned on opposite sides of the chain bar 16 so that the members 24 and 26 are aligned. The stop members 24 and 26 are then connected by suitable connecting members, such as bolts and nuts 42, that extend through corresponding openings in the stop members 24 and 26 and which extend through a pair of spaced apart openings 44 formed in the chain bar 16. If desired, a plurality of openings 44 can be formed along the longitudinal center line of the chain bar 16 so that the attachment 22 can be positioned in the desired position by selecting two of the openings 44.

To properly mount the stop members 24 and 26 of the attachment 22, it is necessary to provide spacers 46 on each side of the chain bar 16 so that the stop members 24 and 26 will be spaced from the chain 14 a sufficient amount to permit the chain 14 to pass freely between the side members 24 and 26. This is best illustrated in FIG. 3. There can be provided one spacer 46 for each pair of prongs 28 and 34, or if desired, a single spacer can be provided by forming a pair of spacers 46 of a sufficient length to span two of the mounting openings 44. In either event, it is evident that the attachment 22 of the invention can be quickly and easily mounted onto the chain saw 10 without the use of any special tools.

It will be evident to those skilled in the art that the invention provides a very useful attachment to improve the utility of the chain saw 10. When small limbs or tree branches are to be cut, they will be stopped and held in between one of the prongs 28 or 34, being forced downwardly toward the chain 14 by the angle of the prongs 28 and 34. By providing an attachment which has a stop member 24 and 26 on each side of the chain bar 16, the small limbs are positively caught and held and the danger is minimized of these being kicked out away from the chain 14. With the design of the attachment 22 of the invention, small limbs can be cut using either the top 18 or bottom 20 of the chain saw 10. The attachment 22 is preferably installed back from the front edge of the chain saw 10 a sufficient distance so that the chain saw can still be used to cut larger members without the necessity of removing the attachment 22. This is illustrated in FIGS. 5 and 6. Although it has been my experience that having two prongs extending from both the top and bottom of each stop member 24 and 26 provide for the most efficient use of the attachment 22, three or more prongs may be used for an attachment designed for larger chain saws, or there may be used two pairs of the stop members 24 and 26 each stop member having two upper and two lower prongs. There is, however, a minimum space that should be provided between each pair of prongs 28 and each pair of prongs 34.

FIG. 4 illustrates the use of the attachment of the invention for cutting kerfs in logs or timbers. In this instance, the attachment 22 can serve as a depth guide as well serving to guide the chain saw along a straight edge 48 (see FIG. 4) laid along the line of the groove that is to be cut in the timber. The rounded rear edges 36 of the lower prongs 38 provide an excellent pivot point with good leverage and control to produce a positive depth control for cutting kerfs. It also may be desirable to replace the forwardmost nut 42 with an axially elongated nut (not shown) that would ride on top of the straight edge 48. The attachment of the invention is also designed to be reversible for positive depth control and straight edge guides. This may be very useful to firefighters for cutting into roofs or walls of a building where the depth of the cut could be critical to avoid cutting into electrical wires or other utilities located and hidden in the walls. Building contractors and demolition contractors may also find this feature useful.

Although the attachment 22 of the invention is designed to be easily installed and removed, because of its unique design, it is not necessary to remove the attachment when the chain saw 10 is used in most applications. The attachment thus provides a safe and practical addition to chain saws that makes chain saws much more useful, safer and more efficient.

Having thus described the invention in connection with the preferred embodiment thereof, it will be evident to those skilled in the art that various revisions and modifications can be made to the preferred embodiment described herein without departing from the spirit and scope of the invention. It is my intention, however, that all such revisions and modifications that are obvious to those skilled in the art will be included within the scope of the following claims.

What is claimed is as follows:

1. An attachment for use with a chain saw having a housing at its inner end containing a motor with a chain bar extending outwardly from the housing and a cutting chain driven by the motor so as to travel longitudinally around the top and bottom of the chain bar, the chain bar having a plurality of longitudinally and equally spaced-apart openings, said attachment comprising: a pair of juxtaposed stop members adapted to be mounted on the chain bar between the housing and the outer end of the chain bar with one of the stop members positioned on each side of the chain bar, each stop member being formed of a single piece of substantially flat, rigid material and having a central connecting member, a first pair of longitudinally spaced apart prongs extending upwardly from the connecting member so that the prongs extend beyond the path of the chain traveling over the top of the chain bar when the stop members are mounted on the chain bar, a second pair of longitudinally spaced apart prongs extending downwardly from the connecting member of each stop member so that the second pair of prongs extend beyond the path of the chain traveling over the bottom of the chain bar when the stop members are mounted on the chain bar, each of the first prongs having a substantially straight rear edge that is at an angle of 20° to 30° from a line perpendicular to the top path of the chain and a front edge that curves rearwardly and joins the rear edge at the outermost point of the first prong, each of the second prongs having a substantially straight front edge that is at an angle of 20° to 30° from a line perpendicular to the bottom path of the chain and a rear edge that curves forwardly and joins the front edge at the outermost point of the second prong, each stop member having a pair of longitudinally spaced apart openings corresponding to the spacing of the openings in the chain bar so as to provide for mounting of the stop members on the chain bar, the openings in each stop member being at substantially the same distance from the front and rear edges of the stop member so as to provide for reversed mounting of the stop members on the chain bar with the curved edge of each of the second prongs being the front edge that provides a pivot point for cutting kerfs, means to space each stop member from the chain bar a sufficient amount to allow the chain to pass without interference between the stop members when the stop members are properly installed on the chain bar, and removable fasteners combined with the openings in the stop members and the chain bar for removably attaching the stop members to the chain bar.

2. The attachment of claim 1 in which the means to space each stop member from the chain bar is a spacer separate from the stop member.

3. The attachment of claim 2 in which the openings in the stop members are spaced so as to correspond to the spacing of the openings in the chain bar thereby providing for varying the position of the attachment along the chain bar.

* * * * *